US007708267B2

(12) United States Patent
Shigeno

(10) Patent No.: US 7,708,267 B2
(45) Date of Patent: May 4, 2010

(54) SHEET FEEDING APPARATUS

(75) Inventor: Kenji Shigeno, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/333,994

(22) Filed: Dec. 12, 2008

(65) Prior Publication Data

US 2009/0152801 A1 Jun. 18, 2009

(30) Foreign Application Priority Data

Dec. 14, 2007 (JP) ..... 2007-323195

(51) Int. Cl.
*B65H 3/06* (2006.01)

(52) U.S. Cl. ..... 271/122; 271/114; 271/116; 271/121

(58) Field of Classification Search ..... 271/122, 271/121, 114, 116, 109, 10.09
See application file for complete search history.

(56) References Cited

U.S. PATENT DOCUMENTS 1,003,087 A * 9/1911 Brady ..... 271/116
5,129,642 A * 7/1992 Svyatsky et al. ..... 271/10.03
5,173,596 A * 12/1992 Kapinos et al. ..... 235/475
6,467,767 B2 * 10/2002 Yano ..... 271/122
7,007,945 B2 * 3/2006 Hiramitsu et al. ..... 271/125
7,354,038 B2 * 4/2008 Watase ..... 271/10.13
7,621,522 B2 * 11/2009 Yasukawa et al. ..... 271/121

FOREIGN PATENT DOCUMENTS

JP 3-227839 10/1991
JP 2000-177874 6/2000

* cited by examiner

*Primary Examiner*—Kaitlin S Joerger
(74) *Attorney, Agent, or Firm*—Fitzpatrick, Cella, Harper & Scinto

(57) ABSTRACT

A sheet feeding apparatus includes stacker for stacking a sheet material; a feed roller for separating the sheet material stacked on the stacker; a rotatable separation roller rotatable by being driven by the feed roller; and a torque limiter for controlling rotation of the separation roller; wherein a second or subsequent sheet material staying in a nip between the feed roller and the separation roller is separated from the separation roller by a rotational direction of the feed roller being changed from a forward rotational direction to a backward direction and by a rotational direction of the separation roller being changed to a backward direction by the feed roller during a first sheet material which is in contact to the feed roller being nipped by the nip; and a first sheet material is fed toward downstream of the nip by the rotational direction of the feed roller being changed from the backward direction to the forward direction.

8 Claims, 10 Drawing Sheets

(a)

(b)

(a)

(c)

(b)

SHEET FEEDING APPARATUS

FIELD OF THE INVENTION AND RELATED ART

The present invention relates to a sheet feeding apparatus. More specifically, it relates to a sheet conveying apparatus provided with a mechanism for preventing the so-called double-feeding or multi-feeding (which hereafter will be referred to as multi-feeding), that is, the problem that two or more sheets are fed out of a recording sheet holder at the same time by a single sheet feeding action.

As examples of the mechanism with which a sheet feeding apparatus is provided to prevent the problem that two or more sheets are fed into the main assembly of an apparatus at the same time, there are the mechanisms which employ a retard roller, a simplified version thereof, etc.

A sheet feeding apparatus employing a retard roller, such as the one disclosed in Japanese Laid-open Patent Application 2000-177874, has a separation roller which is provided with a torque limiter, in order to prevent the so-called multi-feeding. More specifically, the sheet feeding apparatus is provided with a feed roller and a separation roller. The feed roller is rotated in the direction to convey a sheet into the main assembly of an apparatus (rotating feed roller in this direction will be referred to as "forward rotation"). As a sheet (single sheet of medium) is made to enter the area of contact (separation nip) between the feed roller and separation roller, by the feed roller, the separation roller is rotated by the rotation of the feed roller, with the presence of the sheet between the feed roller and separation roller. However, if two or more sheets enter the separation nip, the torque limiter reacts, and affects the rotation of the separation roller. That is, the separation roller is prevented by the torque limiter from being rotated by the forward rotation of the feed roller, and instead, is rotated in the direction opposite to the direction in which it is rotated to convey a sheet downstream, that is, the direction in which a sheet is to be conveyed to be fed into the main assembly of the apparatus (this direction in which separation roller is rotated will be referred to as "backward direction"). The peripheral surface of the separation roller is higher in coefficient of friction than the surface of a sheet. Therefore, the second sheet and sheets thereafter, which are in contact with the separation roller, are conveyed by the backward rotation of the separation roller in the backward direction, that is, the direction opposite from the direction in which the first sheet is being conveyed by the feed roller. Thus, only the sheet which is in contact with the feed roller is conveyed beyond the separation nip. This is how a sheet feeding apparatus employing an ordinary retard roller prevents two or more sheets from being fend and conveyed at the same time beyond the separation nip.

A sheet feeding apparatus employing a simplified version of retard roller also has a separation roller with a torque limiter to prevent two or more sheets from being fed at the same time, as does a sheet feeding apparatus employing a retard roller. A sheet feeding apparatus employing a simplified version of retard roller is different from a sheet feeding apparatus employing an ordinary version of retard roller in that it is not provided with a power source dedicated to the backward rotation of the separation roller. More specifically, as the torque limiter is activated by the entrance of two or more sheets into the separation nip, the separation roller is made to simply stop, instead of being rotated backward. As the separation roller is stopped, the second sheet and the sheets thereafter, which are in contact with the separation roller, are not allowed to move downstream in terms of the sheet conveyance direction, beyond the separation nip. Thus, only the first sheet, that is, the sheet which is in contact with the feed roller is conveyed beyond the separation sheet by the feed roller. This is how the sheet feeding apparatus employing a simplified version of retard roller prevents two or more sheets from being fed and conveyed at the same time beyond the separation nip.

However, the above-described conventional technologies suffer from various problems which are related to the working of the mechanism for preventing the multi-feeding.

First, in the case of a sheet feeding apparatus employing an ordinary retard roller, the driving force for backwardly rotating the separation roller has to be transmitted to the separation roller during a sheet feeding operation. Thus, the sheet feeding apparatus of this type is mechanically more complication, and also, is lager in size, being therefore higher in manufacture cost. Further, the second sheet and the sheet thereafter are forcefully conveyed in the opposite direction from the direction in which they are to be conveyed if they were entered one by one into the separation nip. In other words, the second sheet and the rest in the separation nip are made to rub against the top sheet, that is, the first sheet. Therefore, the sheets sometimes sustain scratch marks or the like.

In the case of a sheet feeding apparatus employing a simplified version of the retard roller, it has to be provided with a mechanism for removing the second sheet and the rest, the leading edges of which are in the separation nip or its immediate adjacencies, away from the separation nip and its immediate adjacencies. One of such mechanisms is provided with a return lever, which is to be operated to remove the sheets, the leading edge portion of which is in the separation nip or immediate adjacencies, from the separation nip or its immediate adjacencies.

In the case of a conventional sheet feeding apparatus employing a simplified version of retard roller and a return lever, the return lever had to be operated, while keeping the feed roller and separation roller separated from each other, in order to prevent the sheets in the separation nip, from being damaged. Thus, the operation of the return lever has to wait until the sheet, which is being conveyed by the feed roller, goes through the separation nip, and reaches the point, beyond which it can be conveyed by a means other than the feed roller.

Thus, while the first sheet is conveyed through the separation nip by the forward rotation of the feed roller, the second sheet and the rest in the separation nip remain therein, and therefore, the back surface of the first sheet, that is, the sheet being conveyed, rubs against the recording surface of each of the sheets remaining in the separation nip, leaving sometimes scratch marks on the recording surfaces of the second sheet and the rest in the separation nip. These scratch marks on the recording surface are rather conspicuous, in particular, when the glossy sheets, such as sheets of photographic paper, are used.

SUMMARY OF THE INVENTION

The primary object of the present invention is to provide a sheet feeding apparatus which has a multi-feeding preventing mechanism, and is capable of preventing sheets from rubbing each other while the sheets are separated and/or conveyed, without having a mechanism dedicated to the prevention of the rubbing.

According to an aspect of the present invention, there is provided a sheet feeding apparatus comprising stacker for stacking a sheet material; a feed roller for separating the sheet material stacked on said stacker; a rotatable separation roller rotatable by being driven by said feed roller; and a torque limiter for controlling rotation of said separation roller; wherein a second or subsequent sheet material staying in a nip between said feed roller and said separation roller is separated from said separation roller by a rotational direction of said feed roller being changed from a forward rotational direction to a backward direction and by a rotational direction of said separation roller being changed to a backward direction by said feed roller during a first sheet material which is in contact to said feed roller being nipped by said nip; and a first sheet material is fed toward downstream of said nip by the rotational direction of said feed roller being changed from the backward direction to the forward direction.

DETAILED DESCRIPTION OF THE PREFERRED EMBODIMENTS

Next, some of the preferred embodiments of the present invention will be described with reference to the appended drawings.

Embodiment 1

Figure 1:
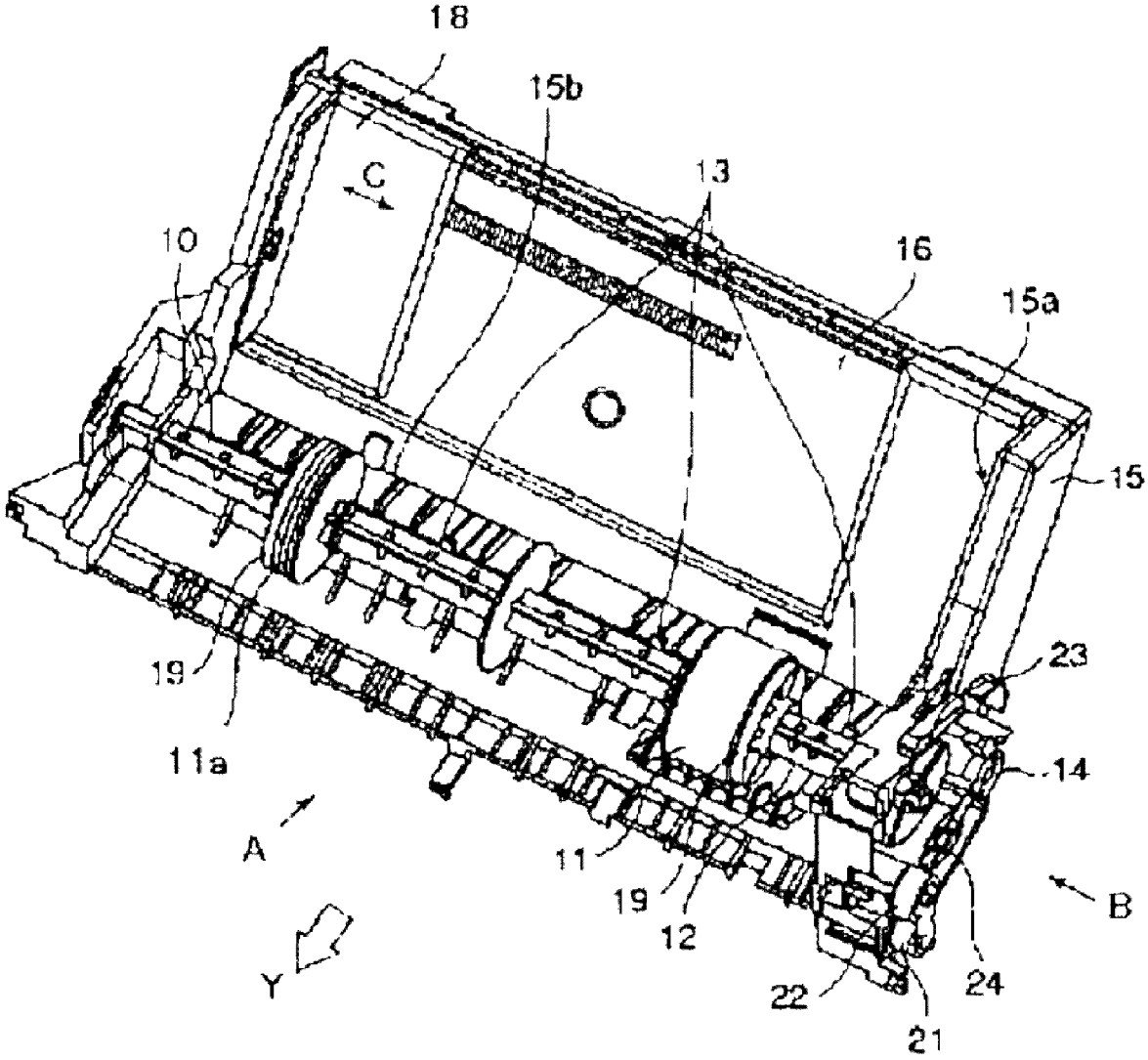
FIG. 1 is a perspective view of a sheet feeding apparatus in one of the preferred embodiments of the present invention.
Figure 2:
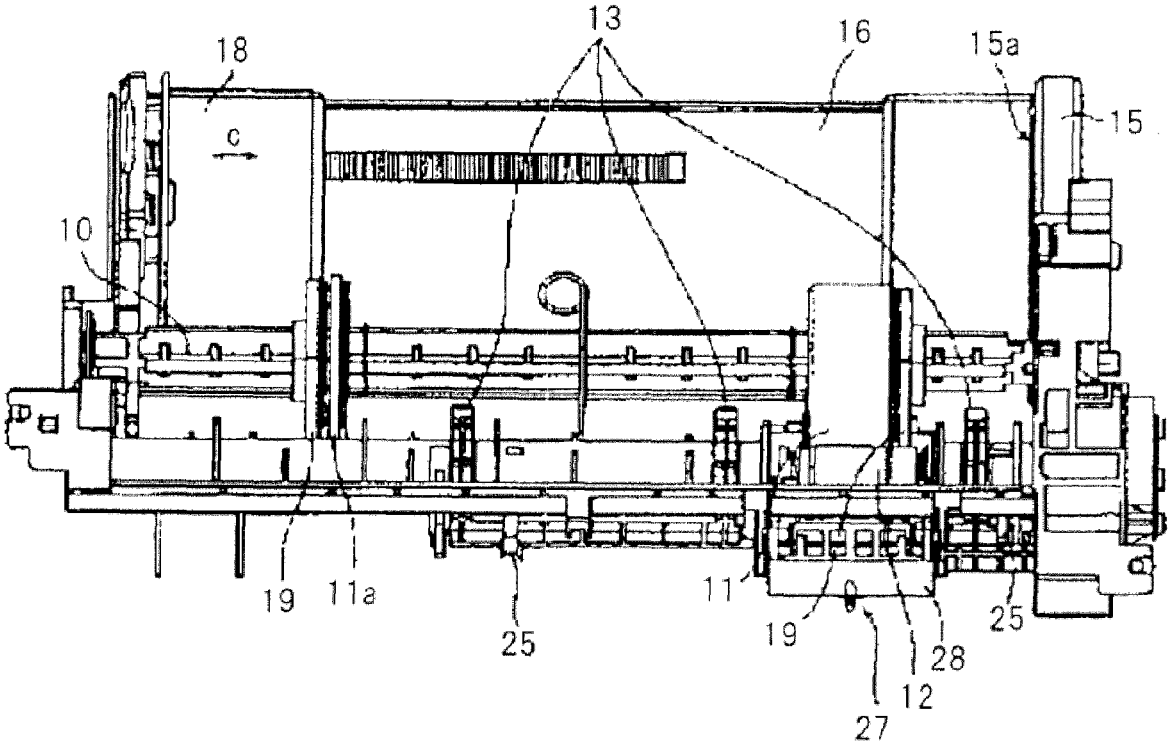
FIG. 2 is a front view of the sheet feeding apparatus shown in FIG. 1.

FIG. 1 is a perspective view of the sheet feeding apparatus in the first preferred embodiment of the present invention. FIG. 2 is a front view of the sheet feeding apparatus shown in FIG. 1, as seen in the direction indicated by an arrow mark A in FIG. 1.

The sheet conveying apparatus in this embodiment has a sheet storage portion, a sheet feeding-and-separating portion, and a portion for preventing two or more sheet from being fed at the same time. Thus, each of these portions will be roughly described in the listed order, with reference to FIGS. 1 and 2, etc.

(A) Sheet Storage Portion

The sheet storage portion has a base 15 and a pressure plate 16. The base 15 is a part of the frame of the sheet feeding apparatus (ASF (automatic sheet feeder)). The pressure plate 16 is for pressing the sheets layered on the base 15, upon a feed roller 11, which will be described later. The sheet storage portion has also a side guide 18 for precisely positioning the sheets in the sheet storage portion, in terms of the direction parallel to the width direction of the sheets. The force (pressure) with which the pressure plate 16 presses the sheets upon the feed roller 11 is provided by a leaf (plate) spring (unshown). Further, the sheet storage portion has a pair of sheet conveying wheels 19 for preventing the fed sheet from coming into contact with the feed roller 11.

The base 15 is provided with positional reference portions 15*a* and 15*b*. The positional reference portion 15*a* is for precisely positioning the sheets in the sheet storage portion, in terms of the direction parallel to the widthwise direction of the sheets. The positional reference portion 15*b* is for precisely positioning the sheets in the sheet storage portion, in terms of the direction in which the sheets are to be conveyed. Thus, the sheet storage portion can smoothly feed the sheets layered on the base 15, into the feeding-and-separating portion.

The pressure plate 16 is rotatably supported by the base 15; the rotational axle of the pressure plate 16, which is attached to the top edge portion of the pressure plate 16, is supported by the base 15. The rotational movement of the pressure plate 16 is regulated by a combination of springs (unshown) and cams (unshown), etc. The pressure plate 16 is kept pressured toward the feed roller 11, by the resiliency of the plate springs (leaf springs). The sheet storage portion is structured so that the pressure plate 16 can be pushed back by the cams with which the feeder shaft gear 23 (which will be described later) is provided, in the direction to move the pressure plate 16 away from the feed roller 11. The timing, with which the sheets on the base 15 are fed into the main assembly of an apparatus to which the sheet feeding apparatus belongs, is controlled by the operation for pressing the pressure roller 16 toward the feed roller 11, or moving the pressure plate 16 away from the feed roller 11.

The sheet conveyance reference portion 15*a* projects from a part of the base 15, and functions as the positional reference for precisely positioning one of the lengthwise edges of each sheet in the sheet storage portion, in terms of the widthwise direction of the sheet. The side guide 18 precisely positions the other lengthwise edge of the sheet, in terms of the widthwise direction of the sheet.

The sheet feeding apparatus is structured so that when it is not being used for feeding the sheets, that is, when it is on standby, the pressure plate 16 remains in a preset position (standby position) which provides a preset amount of distance (gap) between the pressure plate 16 and feed roller 11, allowing a preset amount of sheets to be inserted in layers between the pressure plate 16 and feed roller 11.

The method for storing sheets in layers in the sheet storage portion is as follows: First, sheets are to be inserted into the gap between the feed roller 11 and pressure plate 16 along the sheet conveyance reference portion 15*a*. Then, the side guide 18 is to be moved in the direction indicated by an arrow mark C in FIG. 1 until the gap between the side guide 18 and sheet conveyance reference guide 15 becomes equal to the width of the sheets in the sheet storage portion. Since the side guide 18 is movable in the direction parallel to the widthwise direction of the sheet feeding apparatus, sheets can be smoothly conveyed regardless of the width of the sheets as long as the width of the sheets falls within a preset range.

The side guide 18 is attached so that it is movable relative to the pressure plate 16 in the widthwise direction of the sheets in the sheet storage portion. Further, in order to prevent the side guide 18 from being accidentally moved, the side guide 18 is provided with a pawl (unshown), whereas the pressure plate 16 is provided with the grooves, one of which catches the pawl of the side guide 18 to prevent the side guide 18 from accidentally moving. The side guide 18 is also provided with a lever (unshown), which is to be operated to unlatch the pawl of the side guide 18 from the grooves of the pressure plate 16 to enable the side guide 18 to move.

The sheets layered in the sheet storage portion are pressured downward by gravity. Thus, the leading edge of each sheet, in terms of the sheet conveyance direction, comes into, and remains in contact with, the positional reference portion 15*b* for leading edge. The leading edge position reference portion 15*b* is made up of multiple ribs, minimizing thereby the amount of the friction which occurs between the leading edge position reference portion 15*b* and sheet when the sheet is fed.

(B) Feeding-and-Separating Portion

The feeding-and-separating portion has a roller portion made up of the feeder roller 11 and separation roller 12, and a driving mechanism portion for driving the roller portion. The feed roller 11 of the sheet feeding apparatus in this embodiment plays the role of an auxiliary separation roller, which works in coordination with the separation roller, to separate a sheet to be fed, from the stack of sheets in the sheet storage portion, in addition to the role of feeding the sheets into the main assembly of the apparatus to which the sheet separating apparatus belongs.

The roller portion is made up of: the feed roller 11 for feeding a sheet; an auxiliary roller 11*a* which assists the feed roller 11 in conveying the sheet; the separation roller 12 for helping the sheet in contact with the feed roller 11 separating from the rest of the sheets in the sheet storage portion; and a torque limiter 12*b* which provides the separation roller 12 with a preset amount of torque. The feed roller 11 is rotatably supported by a feed roller shaft 10.

The feed roller 11 and separation roller 12 form the separation nip, which separates the sheet to be conveyed further, from the rest of the sheets in the sheet storage portion. The separation roller 12 is rotatably held by a separation roller holder 28; the axle of the separation roller 12 is rotationally supported by the separation roller holder 28. Further, the separation roller 12 is kept pressured toward the feed roller 11 by a spring 27.

The pressure plate 16 presses the stack of sheets on the base 15, upon the feed roller 11 with a preset timing. The feed roller 11 is rotationally driven while remaining in contact with the sheet kept pressed upon the feed roller 11 by the pressure plate 16. Thus, the top sheet, that is, the sheet in contact with the feed roller 11, is convey by the friction between the peripheral surface of the feed roller 11 and the surface of the top sheet in contact with the feed roller 11. The feed roller 11 conveys the sheet in contact therewith by utilizing the friction between its peripheral surface and the surface of the sheet. Thus, the feed roller 11 is desired to be formed of a rubber, such as EPDM (copolymer of ethylene-propylene-diene), or a resin, such as foamed urethane, which is relatively high in coefficient of friction.

Figure 3:
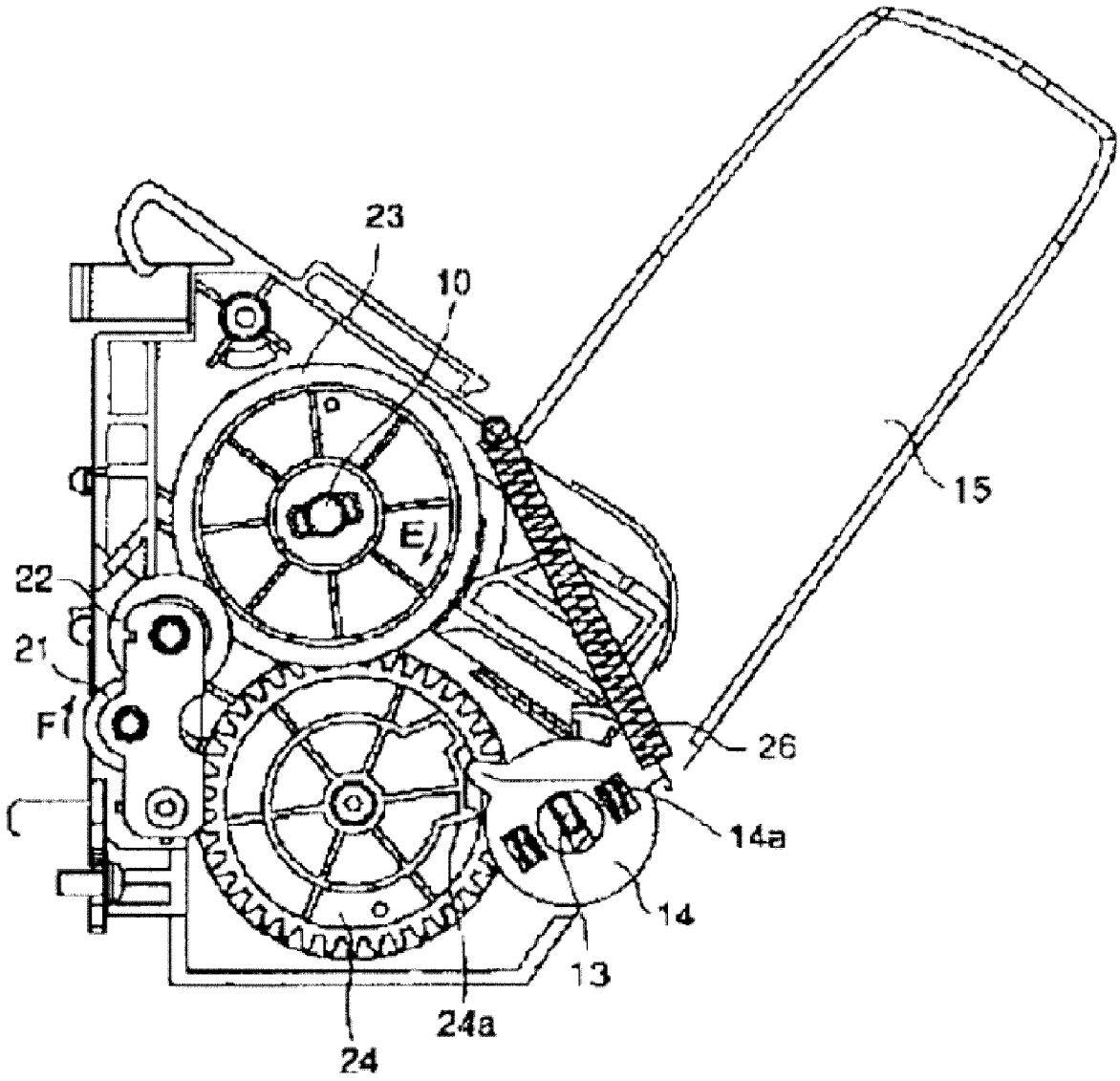
FIG. 3 is a sectional view of the feeding-and-separating portion of the sheet feeding apparatus shown in FIG. 1.
Figure 4:
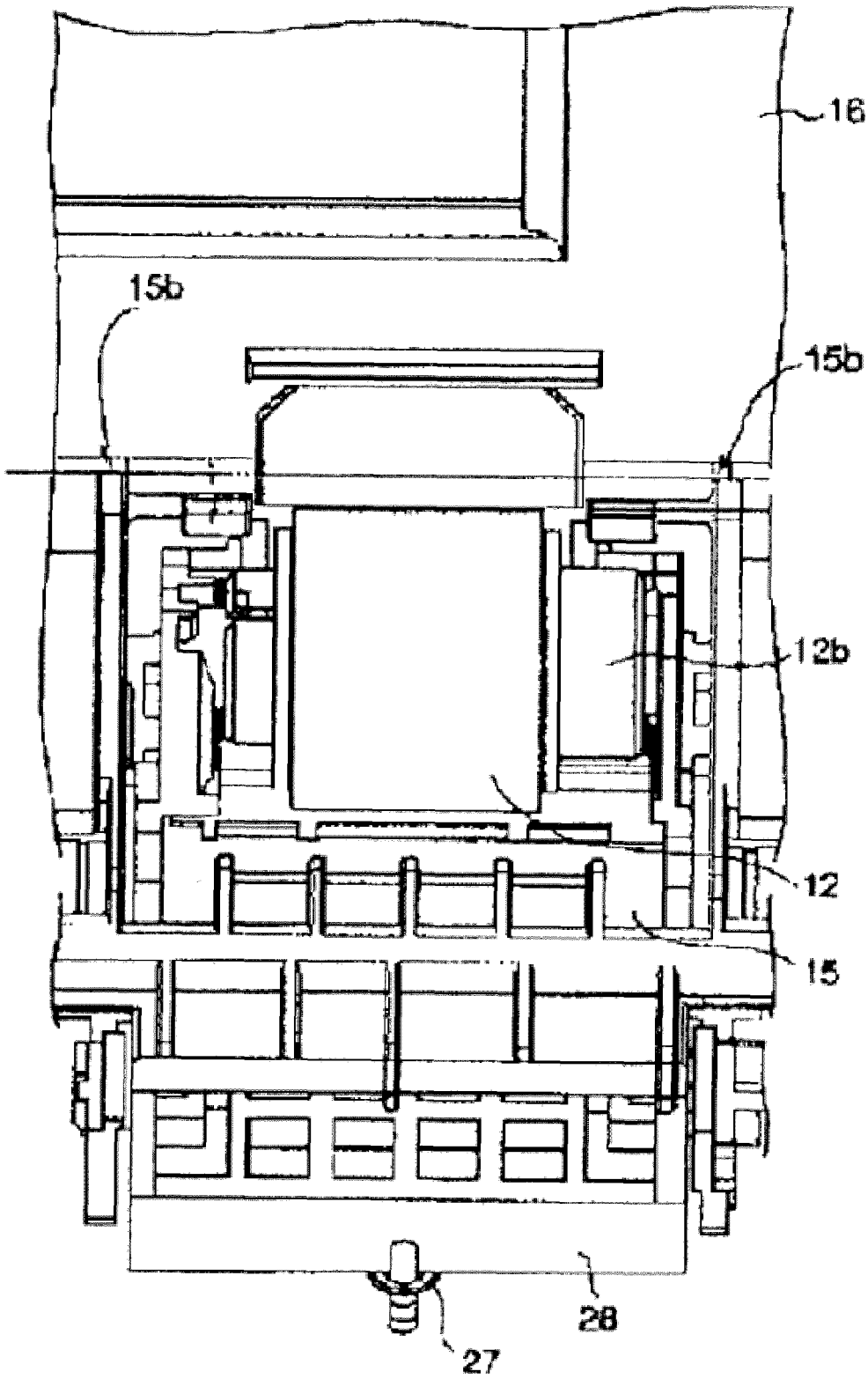
FIG. 4 is a front view of the feeding-and-separating portion of the sheet feeding apparatus shown in FIG. 1.

FIG. 3 is a sectional view of the driving mechanism portion of the feeding-and-separating portion of the sheet feeding apparatus in this embodiment, at a plane perpendicular to the direction indicated by an arrow mark B in FIG. 1. FIG. 4 is a front view of the driving mechanism portion of the sheet feeding apparatus in this embodiment. It should be noted here that the structural components, such as the feed roller shaft 10, feed roller 11, etc, are not shown in FIG. 4.

The driving mechanism portion has: a return levers 13 for preventing two or more sheets from being fed at the same time; and a return lever control cam 14 for transmitting driving force to the return lever 13. Further, the driving mechanism portion has: an input gear 21 for transmitting the driving force transmitted from the driving gear (unshown) of the main assembly; and a step gear 22 which is in mesh with the input gear 21 to transmit the driving force. The driving mechanism portion also has: a feeding shaft gear 23 which transmits the driving force transmitted thereto from the double gear 22 solidly attached to the feeding shaft 10, to the feed roller 11; a control gear 24 which controls the driving of the return lever and separation roller 12.

Referring to FIGS. 2-4, the driving mechanism portion also has: a return lever pressing spring 26 which keeps the return lever 13 pressed so that the return lever 13 are allowed to rotate only in the preset direction; and a return lever spring 25 which keeps the return lever 13 and return lever control cam 14 pressed in the preset direction so that the positional relationship between the return lever 13 and return lever control cam 14 remain stable. Further, the driving mechanism portion has: a separation roller pressing spring 27 which keeps the separation roller 12 pressed toward the feed roller 11; and the separation roller holder 28 which rotatably supports the separation roller 12.

As driving force is transmitted from the driving gear of the main assembly to the input gear 21, the input gear 21 rotates in the direction indicated by an arrow mark F in FIG. 3. As a result, the driving force is transmitted to the feed roller shaft gear 23, while being reduced in speed by the step gear 22. The feed roller shaft gear 23 is rotated in the direction indicated by an arrow mark E in FIG. 3.

The control gear 24 is provided with a cam 24*a*, which is on one of the primary surfaces of the control gear 24. The cam 24*a* is in contact with the cam follower portion 14*a* of the return lever control cam 14, which is kept pressed by the return lever spring 26 in a preset direction. Thus, the cam follower portion 14*a* of the return lever control cam 14 is changed in position by the rotation of the cam 24*a* while remaining in contact with the peripheral surface of the cam 24*a*. That is, the return lever 13 is driven in synchronism with the driving of the feed roller shaft 10, through the feed roller shaft gear 23, control gear 24, and return lever control cam 14, in accordance with the cam profile (shape of peripheral surface of cam 24*a*).

The control gear 24 is also provided with another cam (unshown), which is on the opposite surface from the surface having the cam 24*a*. The driving force from the feed roller shaft 10 is transmitted to the separation roller control cam (unshown) by way of this cam on the other side of the control gear 24. The separation roller 12 is pushed back by the movement of the separation roller control cam in the direction opposite to the direction in which the separation roller 12 is kept pressed toward the separation roller pressing spring 27, so that the separation roller 12 separates from the feed roller 11 with which it is in contact. In other words, the operation for placing the feed roller 11 and separation roller 12 in contact with each other, and the operation for separating them from each other, are controlled in synchronism with the driving of the feed roller shaft 10.

Further, the above described operation for moving the pressure plate 16 toward the feed roller 11, and operation for moving the pressure plate 16 away from the feed roller 11, are controlled by the cams (unshown) with which the lengthwise end portions of the feed roller shaft 10 are provided, one for one. More specifically, as the feed roller shaft 10 is rotated, these cams come into contact with the widthwise end portions of the pressure plate 16, one for one, and press the pressure plate 16, at the same time. As a result, the pressure plate 16 is pushed back in the direction opposite from the direction in which the pressure plate 16 is kept pressed toward the feed roller 11. Thus, the pressure plate 16 is moved away from the feed roller 11.

When the sheets in the sheet storage portion are fed into the main assembly, the friction which occurs between the feed roller 11 and the top sheet of the stack of sheets in the sheet storage portion is greater than the friction between the top sheet and the sheet immediately under the top sheet. Ordinarily, therefore, only the top sheet is fed into the main assembly. However, in a case where sheets of recording medium, which are relatively high in coefficient of surface friction, are used, it is possible that two or more sheets will be fed into the main assembly at the same time. It is also possible, in a case where sheets having the burrs having resulted during the cutting of the sheets are used, or sheets are made to stick to each other by static electricity, that two or more sheets will be fed by the feed roller 11 at the same time.

At this time, referring to FIG. 7, the mechanism in the sheet feeding apparatus in this embodiment, which is capable of separating the top sheet from the rest of the sheets in the sheet storage portion so that only the top sheet is fed into the main assembly, will be described.

Figure 7:
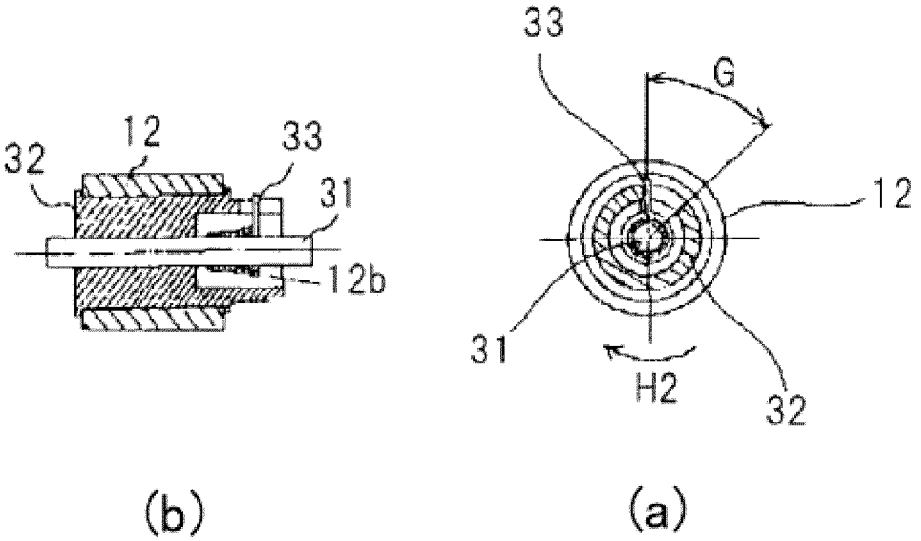
FIGS. 7(*a*) and 7(*b*) are sectional views of the separation roller of the sheet feeding apparatus in the first preferred embodiment of the present invention.

FIG. 7(*a*) is a sectional view of the separation roller 12 of the sheet feeding apparatus in this embodiment, at a plane which is perpendicular to the axial line of the separation roller 12. FIG. 7(*b*) is a sectional view of the separation roller shown in FIG. 7(*a*), at a plane which coincides with the rotational axis of the separation roller 12.

Designated by a referential number 32 is the separation roller shaft, which rotates with the separation roller 12. The separation roller shaft 32 is provided with a torque limiter 12*b*, which has: a coil spring 33 formed of a metallic or resinous substance; and a torque limiter shaft 31 which is solidly attached to the separation roller holder 28 (so that it does not rotate). The torque limiter shaft 31 is fitted in the center hole of the separation roller shaft 32. The coil spring 33 is in the hollow of the torque limiter 12*b*, and is fitted around the torque limiter shaft 31 as if it was tightly wound around the torque limiter shaft 31.

The torque limiter 12*b* is structured so that as the separation roller shaft 32 is subjected to the torque which acts in the direction to rotate the separation roller 12 forward, the grip which the coil spring 33 has on the torque limiter shaft 32 reduces.

If the amount of the abovementioned torque is no less than a preset value, the separation roller 12 is allowed to rotate by a preset angle, loosening thereby the grip which the coil spring 33 has on the torque limiter shaft 31. As long as the torque is greater than the static friction between the coil spring 33 and torque limiter shaft 31, the coil spring is made to slide around the torque limiter shaft 31, allowing therefore, the separation roller 12 to continuously rotate forward.

On the other hand, if the amount of the torque which the separation roller 12 receives is no more than the preset value, the coil spring 33 does not slide around the torque limiter shaft 31, preventing therefore the separation roller 12 from rotating forward; the separation roller 12 remains stationary. That is, the torque limiter 12*b* has the function of preventing the separation roller 12 from rotating forward when the amount of the torque which the separation roller 12 receives is no more than a preset value. In other words, the torque limiter 12*b* sets the bottom limit for the amount of torque necessary to rotate the separation roller 12 forward.

The surface layer of the separation roller 12 is formed of such a substance as rubber or foamed urethane, which is roughly the same in coefficient of friction as that of the feed roller 11. Therefore, when the sheet is not in the separation nip between the feed roller 11 and separation roller 12, the separation roller 12 is rotated by the rotation of the feed roller 11.

In terms of the sheet conveyance direction, the separation nip between the feed roller 11 and separation roller 12 is on the downstream side of the point at which the sheet comes into contact with the feed roller 11 for the first time. The sheet which is in contact with the feed roller 11 is conveyed into the separation nip by the forward rotation of the feed roller 11.

When it is only one sheet that has entered the separation nip, the rotational force (torque) is transmitted from the feed roller 11 to the separation roller 12 through the sheet between the feed roller 11 and separation roller 12, because of the presence of friction between the feed roller 11 and sheet. The amount of the force (grip) which the torque limiter 12*b* is required to stop the separation roller 12 is set to a value which is smaller than the amount of the torque which the separation roller 12 receives from the feed roller 11 through the single sheet between the two rollers 11 and 12, by being assisted by the friction between the feed roller 11 and sheet, and the friction between the sheet and separation roller 12. Therefore, when it is only one sheet that has entered the separation nip, the torque limiter 12*b* does not respond, allowing the rotation (torque) from the feed roller 11 to rotate the separation roller 12 forward. Thus, the sheet is conveyed by the feed roller 11 while remaining pinched between the feed roller 11 and separation roller 12.

When it is two sheets that have entered the separation nip, the rotation (torque) of the feed roller 11 is transmitted to the first sheet by the friction between the feed roller 11 and first sheet, and then, is transmitted to the second sheet by the friction between the first and second sheets. Then, it is transmitted from the second sheet to the separation roller 12 by the friction between the second sheet and separation roller 12. The amount of the rotational resistance which is to be provided by the torque limiter 12*b* to prevent the separation roller 12 from rotating is set to a value which is greater than the amount of the torque which is transmitted to the separation roller 12 from the feed roller 11 through the two sheets, that is, by the friction between the feed roller 11 and first sheet, the friction between the first and second sheets, and friction between the second sheet and separation roller 12. Therefore, the torque limiter 12*b* responds; it stops the separation roller 12. Further, the coefficient of friction between the first and second sheets is smaller than the coefficient of friction between the feed roller 11 and the first sheet. Therefore, only the first sheet is conveyed by the feed roller 11, sliding on the second sheet, while the second sheet remains on the upstream side of the separation nip in terms of the sheet conveyance direction.

(C) Multi-feeding Preventing Portion

As described above, if two sheets enter the separation nip of the sheet feeding apparatus in this embodiment, the sheet feeding apparatus separates the first sheet from the second sheet by the separation nip to convey only the first sheet further. However, if three or more sheets enter the separation nip, it is possible that the separation nip will fail to separate the first sheet from the rest, and therefore, two or more sheets will be conveyed beyond the separation nip. That is, if three or more sheets enter the separation nip, it is possible that the so-called multi-feeding will occur. Further, even if it is only two sheets that enter the separation nip, it is possible that the third sheet will enter the separation nip while the second sheet is still remaining in the separation nip after the first sheet is conveyed forward out of the separation nip. In order to prevent this type of multi-feeding, the sheet feeding apparatus in this embodiment is provided with a portion for preventing the multi-feeding (multi-feeding preventing portion).

The multi-feeding preventing portion is made up of the return lever 13, return lever control cam 14, etc., which were described above. Referring to FIG. 2, the return lever 13 is made up of a supporting shaft, and three levers proper which are integral with the supporting shaft. The two of the three levers proper are at the lengthwise ends of the return lever 13, one for one. Next, referring to FIG. 3, the return lever control cam 14 is supported by the supporting shaft of the return lever 13. The force transmitted to the return lever control cam 14 is transmitted to the return lever 13 through the supporting shaft.

Next, referring to FIGS. 5(*a*)-5(*c*) and FIG. 6, the operation of the sheet feeding apparatus, which is triggered by the command inputted into a recording apparatus to cause the recording apparatus to start a recording operation, will be described.

Figure 5:
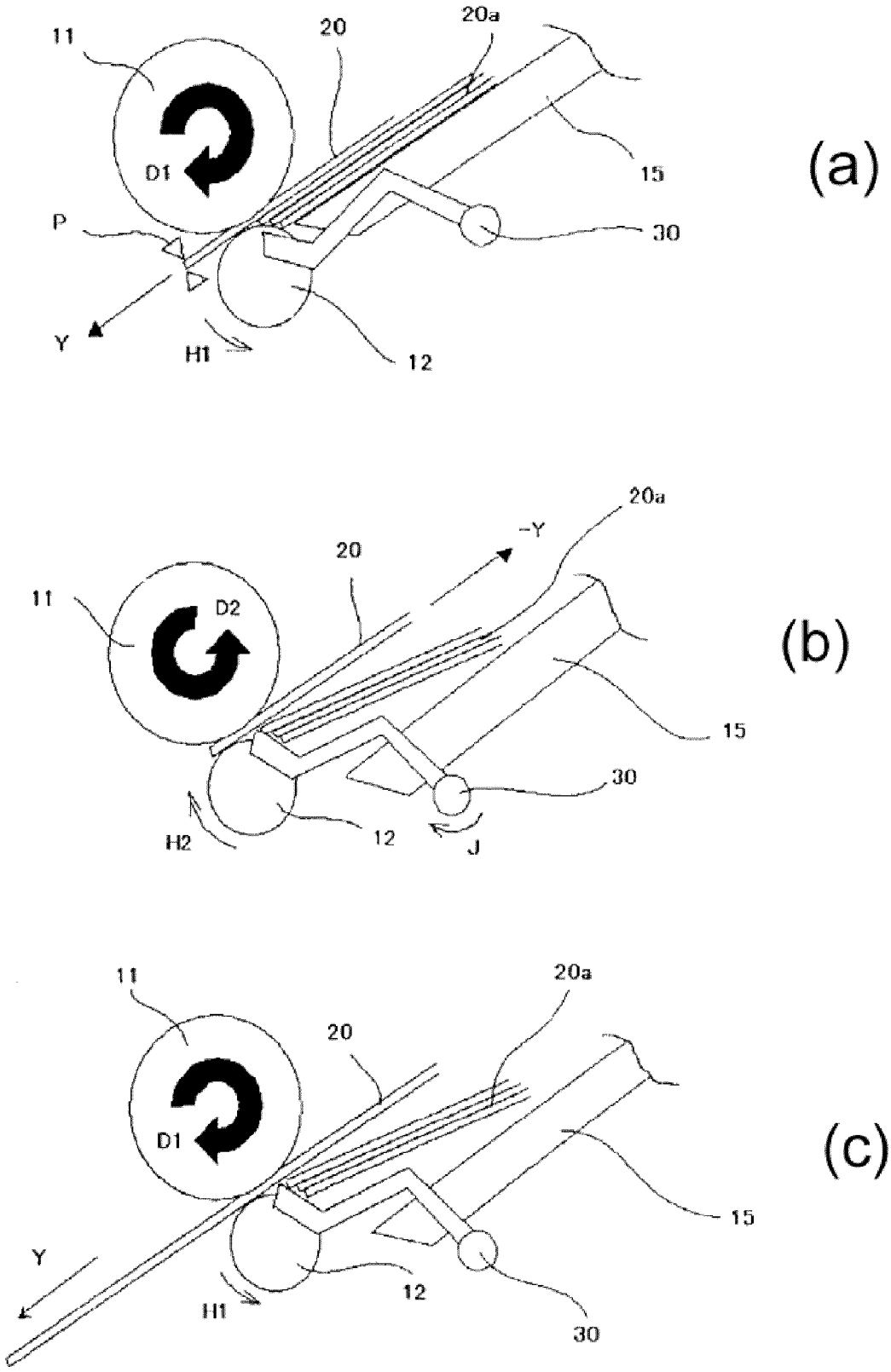
FIGS. 5(*a*), 5(*b*), and 5(*c*) are sectional views of the separation nip portion of the sheet feeding apparatus shown in FIG. 1.
Figure 6:
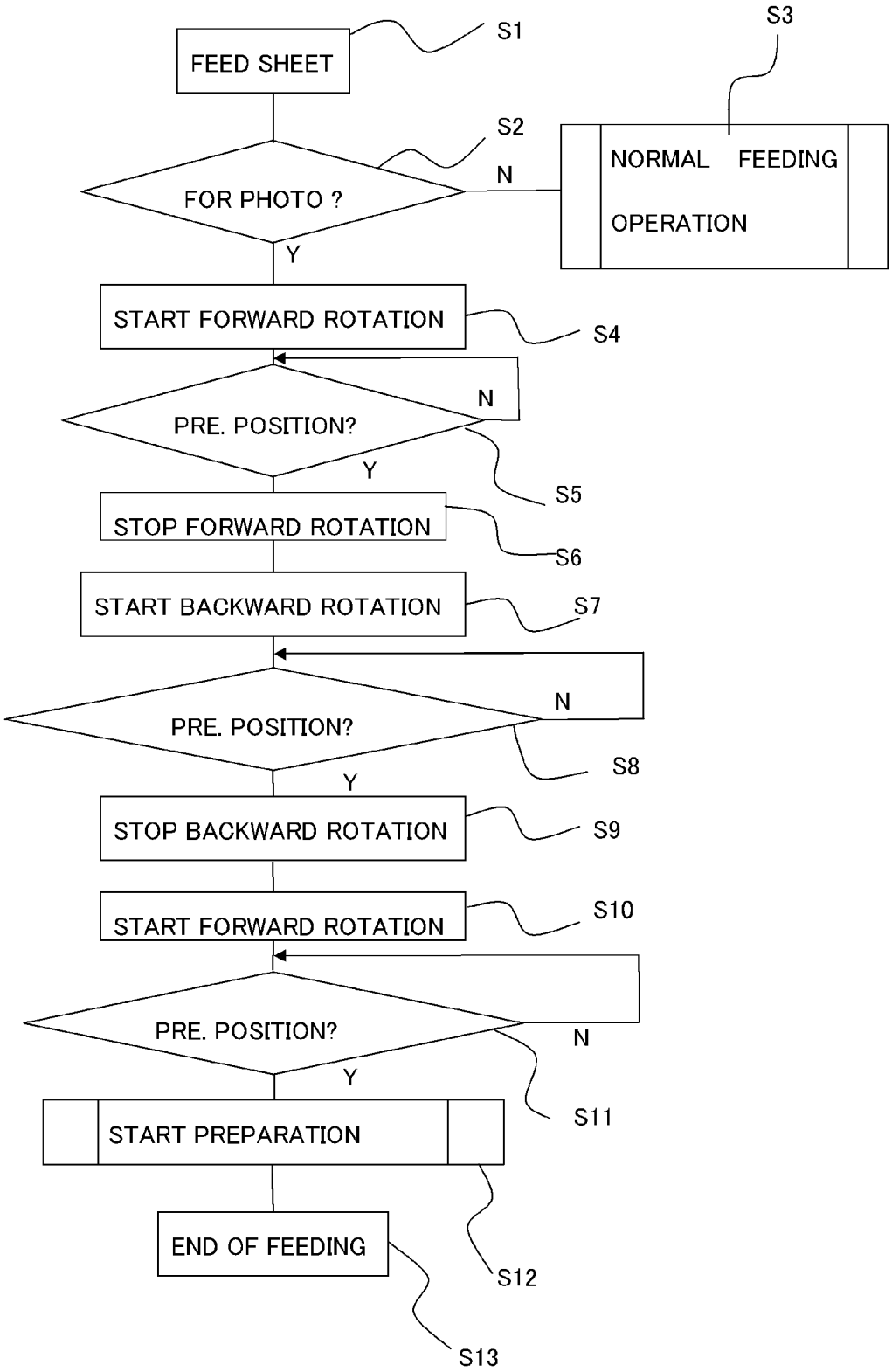
FIG. 6 is a flowchart of the sheet feeding operation of the sheet feeding apparatus shown in FIG. 1.

FIGS. 5(*a*)-5(*c*) are sectional views of the separation nip and its adjacencies of the sheet feeding apparatus, at a plane perpendicular to the feed roller 11 of the apparatus. FIG. 6 is a flowchart of the operation of the sheet feeding apparatus.

As the recording apparatus receives a recording start command, first, it issues a command for conveying a sheet to the recording portion of the recording apparatus (S1). As the recording apparatus issues the command for conveying a recording sheet to the recording portion, it determines what kind of image is recorded on what kind of sheet (S2). If the recording sheets to be used for recording are recording media, such as sheets of photographic paper, which very easily sustains scratch marks, the sheet feeding operation which characterizes the sheet feeding apparatus in this embodiment is carried out. When the recording sheets are not sensitive to scratching, like sheets of ordinary paper, the ordinary sheet feeding operation is carried out (S3).

In a case where the command issued by the recording apparatus was for recording on sheets of photographic medium, the sheet feeding operation which characterizes the sheet feeding apparatus in this embodiment is initiated. First, the pressure plate 16 is pressed by the plate spring (leaf spring) toward the feed roller 11 so that the top sheet in the sheet storage portion is placed in contact with the feed roller 11. Then, the feed roller 11 is rotated in the forward direction (S4). It should be noted here that in the case of the rotation of the feed roller 11, the forward direction is the direction indicated by an arrow mark D1 in FIG. 5(*a*), whereas in the case of the rotation of the separation roller 12, the forward direction is the direction indicated by an arrow mark H1 in the same drawing.

Referring to FIG. 5(*a*), as two or more sheets in the sheet storage portion enter the separation nip, the top sheet 20, that is, the sheet in contact with the feed roller 11, is conveyed into the main assembly of the recording apparatus through the separation nip, whereas the second sheet and thereafter, that is, the sheets which are not in contact with the feed roller 11, remain on the downstream side of the separation nip, because the separation roller 12 is stopped by the action of the torque limiter 12*b*.

Further, referring to FIGS. 7(*a*) and 7(*b*), in terms of the rotational direction of the separation roller 12 (coil spring 33), there is an angular range G in which the coil spring 33 does not act on the separation roller shaft 32. Therefore, the separation roller 12 is allowed to freely rotate by an angle equivalent to the range G, until the coil spring 33 comes into contact with the separation roller 12.

The feed roller 11 is controlled in such a manner that it rotates by at least an angle equivalent to the range G before the sheet enters the separation nip. Therefore, it does not occur that the torque limiter 12*b* of the separation roller 12 does not function as soon as a sheet enters the separation nip. That is, the torque limiter 12*b* is ready to immediately respond by the time the sheet enters the separation nip. Therefore, as soon as two or more sheets enter the separation nip, the torque limiter 12*b* immediately separates the top sheet 20 from the rest, allowing only the top sheet 20 to be conveyed beyond the separation nip by the feed roller 11.

As for the second and subsequent sheets 20*a* which are remaining on the upstream side of the separation nip, they have to be moved out of the adjacencies of the separation nip to prevent the problem that the sheets become scarred as they rub against each other. Therefore, the sheet feeding apparatus in this embodiment is provided with a mechanism for rotating the separation roller 12 in the backward direction to move the sheets remaining in the adjacencies of the separation nip, out of the adjacencies, as is a conventional sheet feeding apparatus employing a retard roller.

Whether or not the top sheet 20 has been conveyed beyond the separation nip by the forward rotation of the feed roller 11 far enough for the leading edge of the top sheet 20 to arrive at a point, which is a preset distance away from the separation nip, is detected by a detecting device P. As the arrival is detected (S5), the forward rotation of the feed roller 11 is temporarily stopped (S6). Then, the rotational direction of the feed roller 11 is changed to the backward direction (S7). Incidentally, the backward rotational direction of the feed roller 11 is the direction indicated by an arrow mark D2 in FIG. 5(*b*), whereas the backward rotational direction of the separation roller 12 is the direction indicated by an arrow mark H2 in the same drawing.

As the feed roller 11 is rotated backward, the separation roller 12 is rotated backward by the rotation of the feed roller 11, by an angle equivalent to the range G, without being interfered by the coil spring 33. As the separation roller 12 is rotated backward by the rotation of the feed roller 11, the second and subsequent sheets remaining in the adjacencies of the separation nip are moved out of the adjacencies by the friction between the separation roller 12 and the sheets.

Referring to FIGS. 5(*a*)-5(*c*), the sheet feeding apparatus in this embodiment is provided with a sheet regulating member 30, which is structured so that its tip can be moved next to the separation nip, or away from the separation nip. Immediately after the starting of the sheet feeding operation, the sheet regulating member 30 is kept in the attitude in which its tip is out of the sheet path. However, as the sheet feeding operation is started, the sheet regulating member 30 is rotated by a cam (unshown) or the like, in the direction indicated by an arrow mark J, in synchronism of the backward rotation of the feed roller 11, so that the portion of the sheet path between the separation nip and sheet storage portion is blocked by the tip of the sheet regulating member 30. Thus, even if the operation for conveying the top sheet 20 is restarted, the second and subsequent sheets are prevented from enter the separation nip, remaining in the area where they do not contact the top sheet 20 while the top sheet 20 is conveyed further.

Meanwhile, the pressure plate 16, which has been pressing the sheets upon the feed roller 11 from the beginning of the sheet feeding operation, is moved away from the sheets, by a cam (unshown) or the like, in synchronism with the backward rotation of the feed roller 11, ensuring that the second and subsequent sheets 20*a* are smoothly moved out of the adjacencies of the separation nip by the backward rotation of the feed roller 11.

The amount by which the feed roller 11 needs to be rotated backward to move the second and subsequent sheets out of the adjacencies of the separation nip is affected by the type, size, thickness, etc., of the sheets. Thus, the sheet feeding apparatus in this embodiment is structured so that the amount by which the feed roller 11 can be rotated backward can be set according to one or more of the abovementioned factors in order to ensure that the amount by which the feed roller 11 is rotated backward matches the sheets being used for recording. Further, the apparatus may be structured to make the rotational range G substantially larger than the angle of the backward rotation of the feed roller 11 so that the apparatus can deal with more types of sheet. The backward rotation of the feed roller 11 is stopped as soon as the leading edge of the top sheet 20 is made to reach the point set in the sheet path according to the sheet being used for recording (S8, S9).

Thereafter, the feed roller 11 is rotated forward (S10). Thus, the top sheet 20 is conveyed to the recording start point, without coming into contact with the second and subsequent sheets 20*a* after their removal from the adjacencies of the separation nip (S11). Then, a preparatory operation for starting recording on the delivered sheet 20 is carried out (S12), and the sheet feeding apparatus in this embodiment ends its operation for feeding the top sheet 20 in the sheet storage portion (S13).

The above described structure for the sheet feeding apparatus in this embodiment makes it possible to move the second and subsequent sheets out of the adjacencies of the separation nip by the backward rotation of the separation roller 12. Thus, the sheet feeding apparatus in this embodiment can separate the top sheet in its sheet storage portion from the second and subsequent sheets in the sheet storage portion, and conveys the top sheet, while preventing the sheets from rubbing each other, without being provided with a mechanism dedicated to the prevention that sheets rub each other in the adjacencies of the separation nip.

Further, after the second and subsequent sheets are moved out of the adjacencies of the separation nip, they are moved further away from the separation nip by the backward rotation of the separation roller 12, which is caused by the rotation of the feed roller 11. Therefore, it does not occur that as the feed roller 11 begins to be rotated forward again to convey the top sheet 20, the top sheet 20 comes into contact with the second and subsequent sheets.

Embodiment 2

Figure 8:
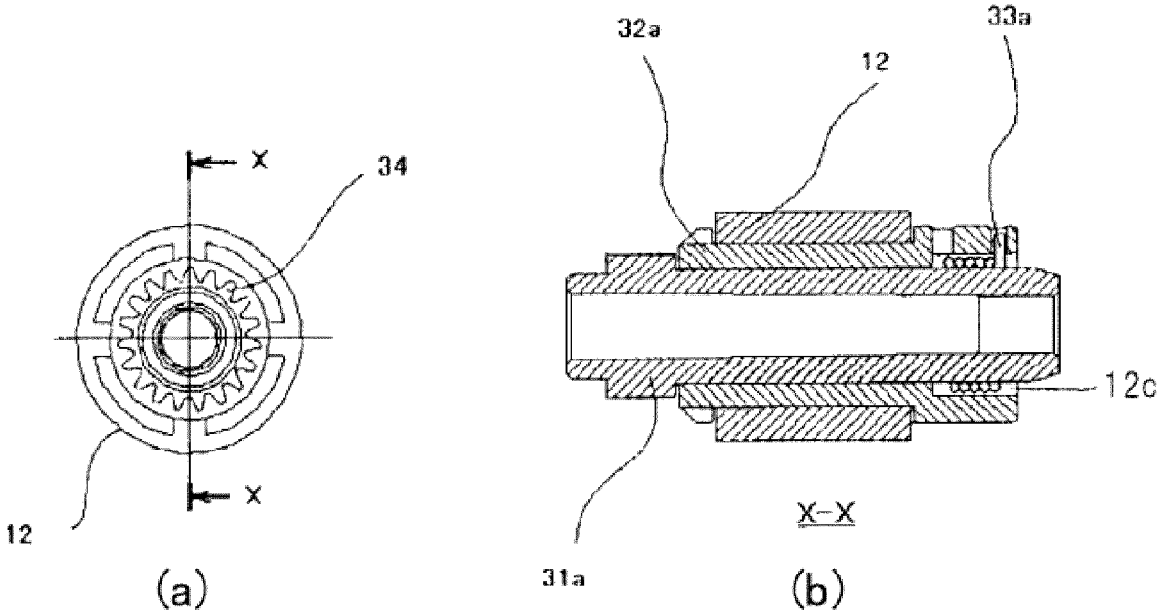
FIGS. 8(*a*) and 8(*b*) are sectional views of the separation roller of the sheet feeding apparatus in the second preferred embodiment of the present invention.
Figure 9:
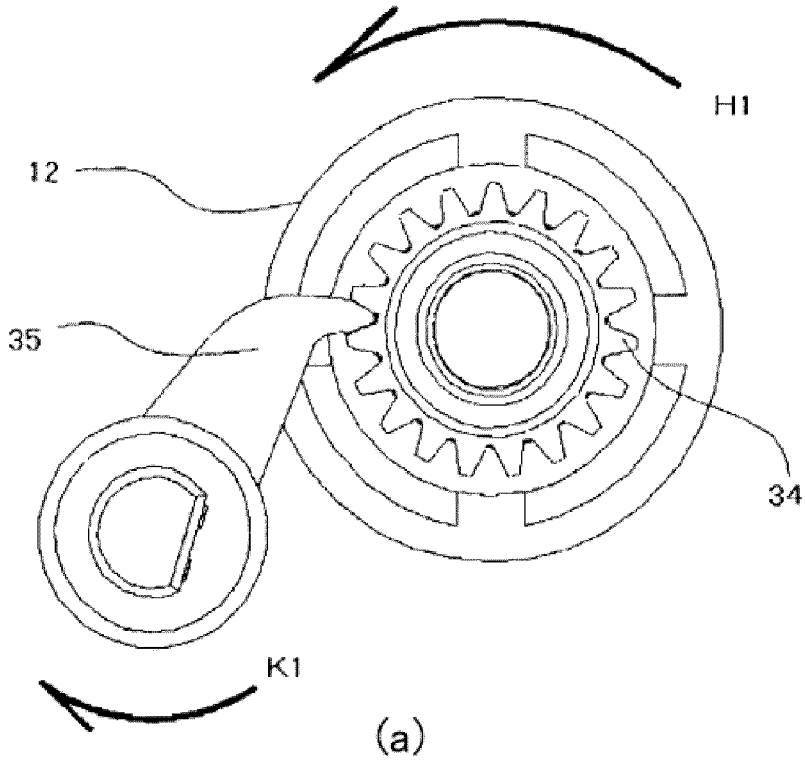
FIGS. 9(*a*) and 9(*b*) are sectional views of the separation roller of the sheet feeding apparatus shown in FIG. 8.
Figure 9:
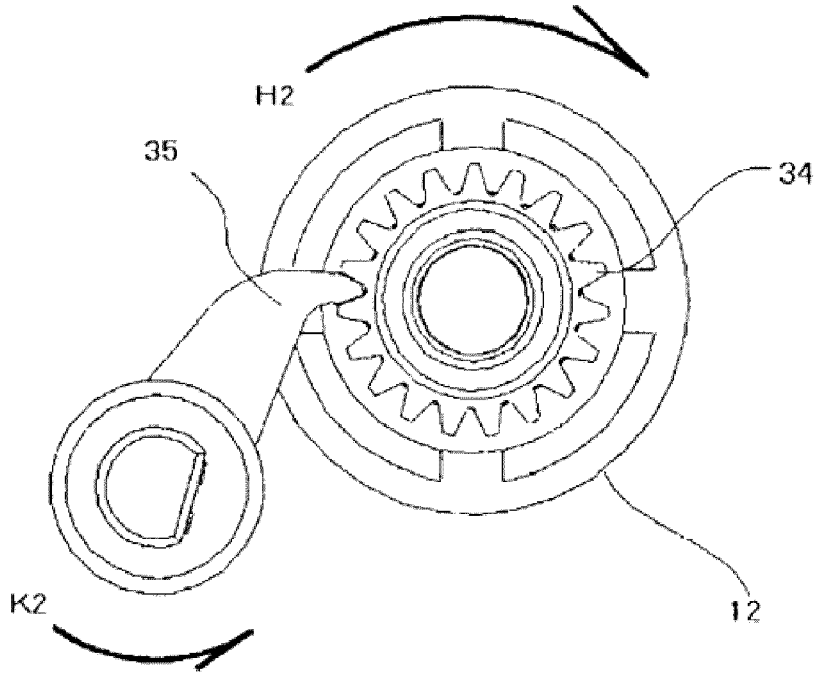

FIGS. 8(*a*) and 8(*b*) and FIGS. 9(*a*) and 9(*b*) are sectional views of the separation roller of the sheet feeding apparatus in the second preferred embodiment of the present invention. FIG. 8(*a*) and FIGS. 9(*a*) and 9(*b*) are sectional views of the separation roller, at a plane perpendicular to the rotational axis of the separation roller. FIG. 8(*b*) is a sectional view of the separation roller, at a plane which coincides with the rotational axis of the separation roller. The sheet feeding apparatus in this embodiment is the same as that in the first embodiment, except for the separation roller structure.

Referring to FIG. 8, designated by a referential number 32*a* is a separation roller shaft, which rotates with the separation roller 12. The coil spring 33*a* of the torque limiter 12*c* is fitted around the torque limiter shaft 31*a*, as if it were wound around the torque limiter shaft 31*a*, which is supported by the separation roller holder 28. The torque limiter 12*c* is structured so that the grip which the coil spring 33*a* has on the separation roller shaft 32*a* functions as a torque limiting means. Further, the torque limiter shaft 31*a* is provided with a catch portions 34.

Referring to FIGS. 9(*a*) and 9(*b*), the sheet feeding apparatus in this embodiment is provided with a stopper 35, which is in the adjacencies of the separation roller 12. The stopper 35 is kept pressed by a spring (unshown) in the direction indicated by an arrow mark K1 in the drawing, and latches with the catch portion 34 of the torque limiter shaft 31*a*.

Next, referring to FIG. 9(*a*), the torque transmitted to the separation roller 12 in the direction to rotate the torque limiter shaft 31*a* in the direction indicated by the arrow mark H1 adds to the force which the catch portion 34 of the torque limiter shaft 31*a* receives from the stopper 35 in the direction indicated by the arrow mark K1. Therefore, the torque limiter shaft 31*a* remains locked by the stopper 35, being prevented from rotating in the direction indicated by the arrow mark H1.

On the other hand, referring to FIG. 9(*b*), the torque transmitted to the separation roller 12 in the direction to rotate the torque limiter 31*a* in the direction indicated by the arrow mark H2 acts in the direction to push back the force applied to the catch portion 34 of the torque limiter shaft 31*a* by the stopper 35 in the direction indicated by the arrow mark K2. Thus, the stopper 35 disengages from the catch portion 34 of the torque limiter shaft 31*a*. That is, as the torque limiter shaft 31*a* is rotated in the direction indicated by an arrow mark H2, the stopper 35 disengages from the catch portion 34 of the torque limiter shaft 31*a*, allowing thereby the toque limiter shaft 31*a* (separation roller 12) to rotate in the direction indicated by the arrow mark H2.

As the forward rotation of the feed roller 11 is continued after the entrance of the sheet(s) into the separation nip, the torque transmitted to the separation roller 12 from the feed roller 11 acts in the direction to rotate the separation roller 12 in its forward direction, that is, the direction indicated by the arrow mark H1. At this point in time, however, the torque limiter shaft 31*a* remains locked by the stopper 35, as shown in FIG. 9(*a*), and therefore, the torque limiter shaft 31*a* cannot rotate in the direction indicated by the arrow mark H1. Thus, the coil spring 33*a* fitted around the torque limiter shaft 31*a* acts on the separation roller shaft 32*a*, preventing thereby the separation roller 12 from rotating. That is, as two or more sheets enter the separation nip, the torque limiter 12*c* functions to prevent the separation roller 12 from rotating, so that only the top sheet 20 is conveyed beyond the separation nip by the feed roller 11.

Further, as the feed roller 11 is rotated backward in order to move the second and subsequent sheets, which are in the adjacencies of the separation nip, out of the adjacencies, the torque transmitted from the feed roller 11 to the separation roller 12 acts to rotate the separation roller 12 backward, that is, the direction indicated by the arrow mark H2. However, this torque acts in the direction to disengage the stopper 35 from the catch portion 34, as shown in FIG. 9(*b*). Thus, the torque limiter shaft 31*a* is freed from the stopper 35, and rotates with the coil spring 33*a* fitted around the torque limiter shaft 31*a*, in the direction indicated by the arrow mark H2. That is, the coil spring 33*a* rotates with the separation roller shaft 32*a*. In other words, the torque limiter 12*c* does not interfere with the backward rotation of the separation roller 12, allowing the separation roller 12 to move the second and subsequent sheets, which are in the adjacencies of the separation nip, out of the adjacencies of the separation nip.

That is, the above described structural arrangement of the sheet feeding apparatus in this embodiment makes it possible to remove the second and subsequent sheets from the adjacencies of the separation nip by the backward rotation of the separation roller 12. Therefore, the sheet feeding apparatus in this embodiment can prevent the sheets from rubbing each other while they are separated or conveyed, without requiring a mechanism dedicated to the prevention of the problem that sheets rub each other while they are separated or conveyed.

Embodiment 3

Figure 10:
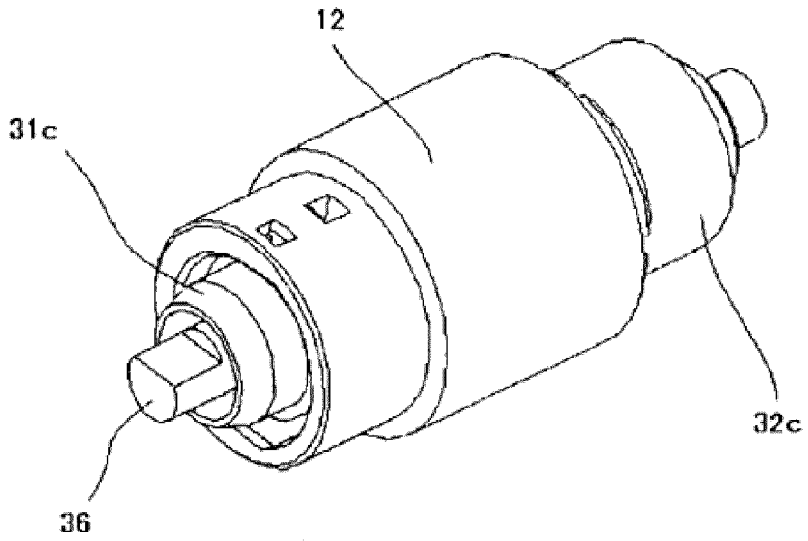
FIGS. 10(*a*), 10(*b*), and 10(*c*) are perspective and sectional views, respectively, of the separation roller of the sheet feeding apparatus in the third preferred embodiment of the present invention.
Figure 10:
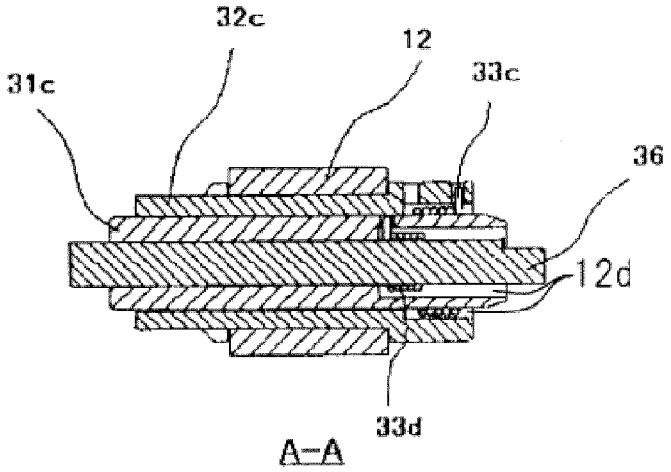
Figure 10:
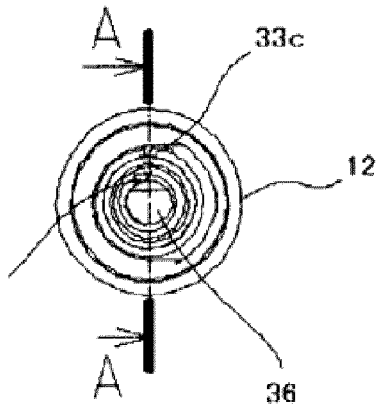

FIG. 10(*a*) is a perspective view of the separation roller of the sheet feeding apparatus in the third preferred embodiment of the present invention, and FIGS. 10(*b*) and 10(*c*) are sectional views of the separation roller, at a plane perpendicular to the rotational axis of the separation roller, and a plane which coincides with the rotational axis of the separation roller, respectively. The sheet feeding apparatus in this embodiment is the same as the sheet feeding apparatus in the first embodiment, except for the separation roller structure.

Referring to FIGS. 10(*a*)-10(*c*), designated by a referential number 32*c* is the shaft of the separation roller 12, which rotates with the separation roller 12. The torque limiter 12*d* is provided with a torque limiter shafts 31*c* and 36, and coil springs 33*c* and 33*d*. The coil springs 33*c* and 33*d* are fitted around the shafts 31*c* and 36, as if they were tightly wound around the shafts 31*c* and 36, respectively. One of the lengthwise ends of the shaft 36 is D-shaped in cross section, ensuring that the shaft 36 remains solidly attached to the separation roller holder 28.

The torque limiter 12*d* is structured so that the forward rotation of the separation roller 12 is controlled by the amount of the grip which the coil spring 33*c* has on the separation roller shaft 31*c*. Further, the torque limiter 12*d* is structured so that the backward rotation of the separation roller 12 is controlled by the amount of the grip which the coil spring 33*d* has on the shaft 36.

As the forward rotation of the feed roller 11 is continued after the entrance of the sheet(s) into the separation nip, the torque transmitted to the separation roller 12 acts in the direction to rotate the separation roller 12 forward. However, the coil spring 33*d* is fitted around the shaft 36 in such a manner that as the separation roller 12 is rotated forward, the coil spring 33*d* increases in the amount of the grip it has on the shaft 36, preventing thereby shaft 36 from rotating. On the other hand, the coil spring 33*c* is fitted around the shaft 31*c* in such a manner that as the separation roller 12 is rotated forward, the coil spring 33*c* reduces in the amount of the grip it has on the shaft 31*c*, affecting the rotation of the separation roller shaft 32*c* of the separation roller 12. Therefore, when the separation roller 12 is rotated forward, the coil spring 33*c* and shaft 31*c* of the torque limiter 13*d* function as the torque limiter. Therefore, as two or more sheets enter the separation nip, the separation roller is not allowed to rotate forward, allowing thereby only the top sheet 20 to be conveyed by the feed roller 11.

Further, as the feed roller 11 is rotated backward to remove the second and subsequent sheets in the adjacencies of the separation nip, from the adjacencies, the torque transmitted to the separation roller 12 from the feed roller 11 acts on the separation roller 12 in a manner to rotate the separation roller 12 backward. However, the separation roller shaft 32*c* cannot rotate, because the coil spring 33*c* is fitted around the shaft 31*c* in such a manner that as the separation roller 12 is rotated backward, it increases in the amount of the grip it has on the shaft 31*c*. On the other hand, the coil spring 33*d* is fitted around the shaft 36 in such a manner that as the separation roller 12 is rotated backward, the coil spring 33*d* reduces in the amount of the grip it has on the shaft 36, affecting the rotation of the torque limiter shaft 31. In other words, when the separation roller 12 is rotated backward, the coil spring 33*d* and shaft 36 of the torque limiter 12*d* function as the torque limiter. Therefore, when the feed roller 11 is rotated backward, the separation roller 12 is allowed to be rotated by the rotation of the feed roller 11. Therefore, as two or more sheets enter the separation nip, the separation roller is allowed to be rotated backward to remove the second and subsequent sheets in the adjacencies of the separation nip, from the adjacencies.

That is, the above described structure of the sheet feeding apparatus in this embodiment makes it possible to move the second and subsequent sheets out of the adjacencies of the separation nip by the backward rotation of the separation roller 12. In other words, the sheet feeding apparatus in this embodiment separates the top sheet in its sheet storage portion from the second and subsequent sheets in the sheet storage portion, and conveys only the top sheet, while preventing the sheets from rubbing each other during the separation and conveyance of the sheets, without being provided with a mechanism dedicated to the prevention of the problem that the sheets rub each other during their separation and/or conveyance.

Embodiment 4

Figure 11:
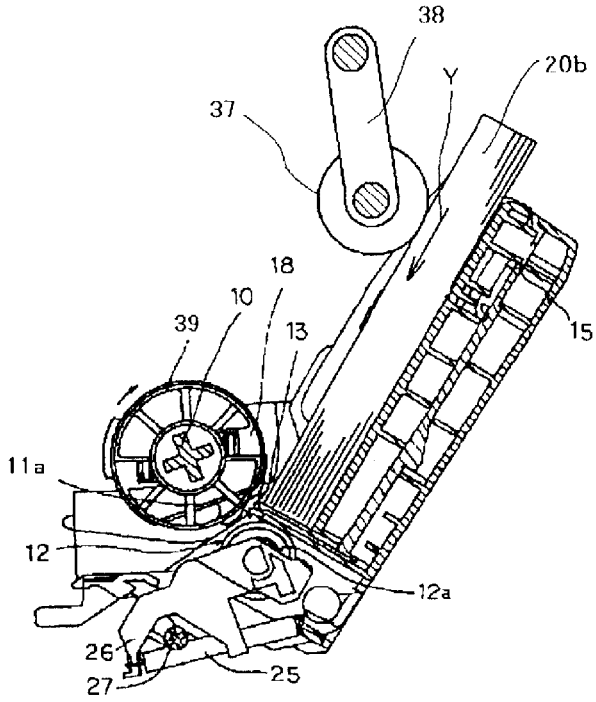
FIG. 11 is a sectional view of the sheet feeding apparatus in the fourth preferred embodiment of the present invention.
Figure 12:
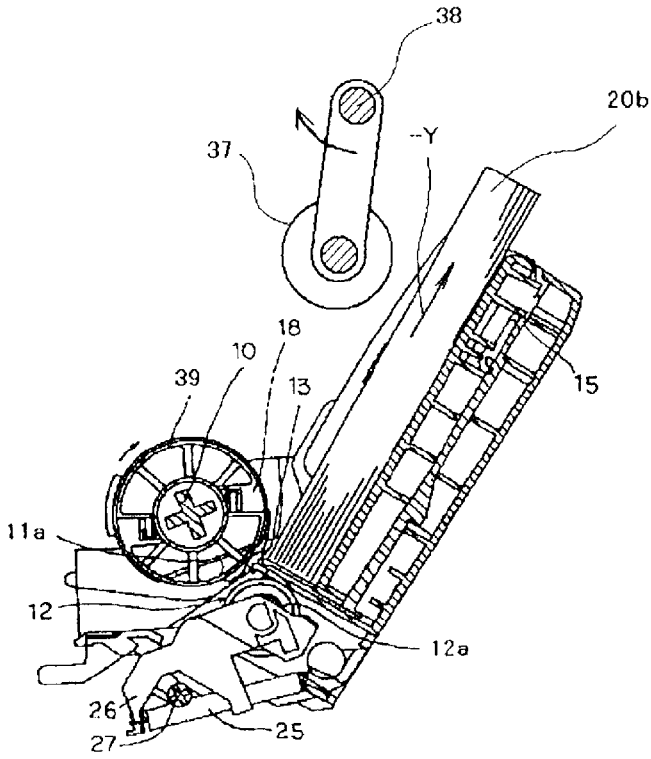
FIG. 12 is also a sectional view of the sheet feeding apparatus in the fourth preferred embodiment of the present invention.

FIGS. 11 and 12 are the sectional views of the sheet feeding apparatus in the fourth preferred embodiment of the present invention. The sheet feeding apparatus in this embodiment is different from that in the first embodiment in that the former is provided with a feed roller dedicated to the separation of two or more sheets, in addition to the feed roller 11 for feeding the sheet(s) into the separation nip. Other structural features of the sheet feeding apparatus in this embodiment are the same as those of the sheet feeding apparatus in the first embodiment.

FIG. 11 shows the sheet feeding apparatus in this embodiment. The feed roller 37 is rotatably supported by a feed roller supporting-and-regulating member 38. The sheets 20*b* are stored in layers on the base 15 of the sheet feeding apparatus (automatic sheet feeder), and are fed by the feed roller 37 into the separation nip between the feed roller 39 and separation roller 12, which are for separating the top sheet 20 from the rest 20*b*. The sheet feeding apparatus in this embodiment is structured so that the feed roller 39 begins to rotate forward in synchronism with the rotation of the feed roller 37. As the feed roller 37 is rotated, the sheet(s) 20*b* are fed into the separation nip, in which the top sheet is separated from the rest by the forward rotation of the feeding roller 39, and the function of the torque limiter of the separation roller 12, so that only the top sheet will be conveyed beyond the separation nip by the feed roller 39.

After the top sheet is conveyed past the separation nip, the feed roller 39 is rotated backward to remove the second and subsequent sheets in the adjacencies of the separation nip, therefrom. As the feed roller 39 is rotated backward, the feed roller supporting-and-regulating member 38 is rotated by a cam (unshown) or the like in the direction to separate the feed roller 37 from the sheets stacked in the sheet storage portion, in synchronism with the starting of the backward rotation of the feed roller 39, ensuring that the second and subsequent sheets in the adjacencies of the separation nip are smoothly removed therefrom.

As described above, the structural arrangement for the sheet feeding apparatus in this embodiment makes it possible for the second and subsequent sheets in the adjacencies of the separation nip to be removed therefrom by the backward rotation of the separation roller 12, even if the sheet feeding apparatus is provided with both a sheet feed roller dedicated to the feeding of the sheet(s) into the separation nip, and a feed roller dedicated to the separation of the top sheet from the rest. In other words, the present invention can make it possible to prevent the problem that the sheets rub each other while being fed into the main assembly of a recording apparatus by the sheet feeding apparatus, without providing the sheet feeding apparatus with a mechanism dedicated to the prevention of this problem.

According to the preferred embodiments described above, it is possible to provide a sheet feeding apparatus, which has a mechanism for preventing the multi-feeding, that is, the problem that two or more sheets are fed into the main assembly of a recording apparatus, and therefore, is capable of preventing the problem that the sheets rub each other while they are separated and/or conveyed past the separation nip, without providing the sheet feeding apparatus with a mechanism dedicated to the prevention of the problem.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 323195/2007 filed Dec. 14, 2007 which is hereby incorporated by reference.

What is claimed is:

1. A sheet feeding apparatus comprising:

a stacker for stacking a sheet material;

a feed roller for separating the sheet material stacked on said stacker;

a rotatable separation roller rotatable by being driven by said feed roller; and a torque limiter for controlling rotation of said separation roller; and wherein a second or subsequent sheet material staying in a nip between said feed roller and said separation roller is separated from said separation roller by a rotational direction of said feed roller being changed from a forward rotational direction to a backward direction and by a rotational direction of said separation roller being changed to a backward direction by said feed roller during a first sheet material which is in contact to said feed roller being nipped by said nip; and a first sheet material is fed toward downstream of said nip by the rotational direction of said feed roller being changed from the backward direction to the forward direction.

2. A sheet feeding apparatus according to claim 1, wherein when a single sheet material enters said nip, said torque limiter permits said separation roller to be rotated by said feed roller thus feeding the sheet material toward downstream of said nip, and when a plurality of sheet materials enter said nip, said torque limiter prevents the rotation of said separation roller, thus staying the second and/or subsequent sheet material in said nip.

3. A sheet feeding apparatus according to claim 1, wherein said torque limiter provides a rotational region in which said separation roller is freely rotatable in the backward direction.

4. A sheet feeding apparatus according to claim 1, wherein said torque limiter includes a torque limiter shaft and a fixing member for preventing rotation of said torque limiter shaft, and said fixing member releases said torque limiter shaft when said separation roller rotates in the backward direction.

5. A sheet feeding apparatus according to claim 1, wherein when a single sheet material is nipped by said nip, said torque limiter permits said separation roller to be rotated by said feed roller irrespective of the rotational direction of said feed roller.

6. A sheet feeding apparatus according to claim 1, further comprising blocking means for blocking said nip and said stacker after the rotational direction of said feed roller is changed from the forward rotational direction to the backward rotational direction.

7. A sheet feeding apparatus according to claim 1, wherein said feed roller is capable of changing an amount of rotation of said feed roller in the backward direction until the rotational direction of said feed roller is changed from the forward direction to the backward direction.

8. A sheet feeding apparatus according to claim 1, further comprising detecting means, provided at a position downstream of said nip with respect to a feeding direction of the sheet material, for detecting the sheet material, wherein when said detecting means detects the sheet material, the rotational direction of said feed roller is changed from the forward direction to the backward direction.

* * * * *